US006058980A

United States Patent [19]

Scari et al.

[11] Patent Number: 6,058,980

[45] Date of Patent: May 9, 2000

[54] METHOD FOR CUTTING A SELVEDGE OF A WEFT INSERTION SIDE OF A RAPIER LOOM

[75] Inventors: Diego Armando Scari; Marco Scari, both of Brugherio, Italy

[73] Assignee: Gividi-Italia S.p.A., Brugherio, Italy

[21] Appl. No.: 09/153,239

[22] Filed: Sep. 15, 1998

[51] Int. Cl.[7] ..... D03D 49/70; D03D 47/40

[52] U.S. Cl. ..... 139/302; 139/194; 139/430

[58] Field of Search ..... 139/430, 433, 139/195, 302, 194

[56] References Cited

U.S. PATENT DOCUMENTS

| | | | |
|---|---|---|---|
| 3,297,057 | 1/1967 | Mizuno et al. | 139/302 |
| 3,626,991 | 12/1971 | Backenecker | 139/302 |
| 3,736,965 | 6/1973 | Yates | 139/302 |
| 3,744,533 | 7/1973 | Yano et al. | 139/302 |
| 4,520,850 | 6/1985 | Cramer et al. | 139/302 |
| 4,607,667 | 8/1986 | Gibson | 139/302 |
| 5,735,316 | 4/1998 | Hehle | 139/194 |

FOREIGN PATENT DOCUMENTS 0 898 001 12/1999 European Pat. Off. .

*Primary Examiner*—Andy Falik
*Attorney, Agent, or Firm*—Greenblum & Bernstein, P.L.C.

[57] ABSTRACT

A method for cutting a selvedge on a weft thread insertion side of a rapier loom equipped with a weft thread supply by creating a free space of warp threads arranged separately from a main warp body. The weft thread is inserted through an open shed of the warp body. The inserted weft thread is beaten, and inserted into a holding device which subjects it tension. The wet thread is cut after being beaten and while subject to tension. The end of the weft thread is inserted it into the open shed of the warp after the cutting.

9 Claims, 3 Drawing Sheets

METHOD FOR CUTTING A SELVEDGE OF A WEFT INSERTION SIDE OF A RAPIER LOOM

BACKGROUND OF THE INVENTION

The present invention concerns a method of cutting the selvedge on the weft insertion side of a loom operated using only one weft thread supply bobbin and an implementation of the method on a rapier loom.

DESCRIPTION OF BACKGROUND INFORMATION

In processing threads on a rapier loom the problem exists in the cutting of the weft thread on the weft insertion side. The problem arises as each weft thread on a rapier loom is inserted from the same side of the fabric by the carrying clamp which takes over the thread: for this purpose it is necessary that before a new weft thread is inserted the tail end of the preceding weft thread is cut and cleared away in such a manner that the leading end of the new weft thread can be established.

For solving this problem the current practice provides an arrangement in which on the weft insertion side a thin strip of a so-called false selvedge is formed at the side of the main warp body, which will become part of the fabric, separated from the main warp body by a space free of warp threads of a few millimeters, or of 1 to 2 cm at the most. On the other side of the false selvedge the weft threads are left dangling out amply over a couple of centimeters which subsequently are cut by a common scissors arrangement. After the actual weaving process is completed, i.e. at a certain distance from the weaving point, the weft threads then are cut between the fabric produced and the false selvedge which operation can be effected easily and with great precision as the weft threads connecting the fabric with the false selvedge are well tensioned and can easily be cut in the "corridor". In this manner an edge of the fabric is formed from which short ends of the weft threads are protruding, all perfectly cut along a straight line. This known method presents the advantage that owing to the ample space available at the side of the fabric this method is applicable also on machines in which the weft threads are supplied from more than one source, e.g. in a plurality of colours, which arrangement due to its nature requires sufficient space for the weft changing mechanism on the weft insertion side. This known method, however, shows a grave disadvantage most important from the economic point of view, implied by the generation of a high percentage of waste material as the whole false selvedge with its warp threads and its weft threads sticking out on both sides (and on the outer side the threads dangling out often are of a lengths of many centimeters) represents a loss which expressed as a percentage of the production is of the order of several percentage points which renders the product more expensive. In cases in which such losses of materials are inevitable due to the necessity of providing sufficient space for the weft thread changer devices this loss of production is accepted as a consequence of the loom operating mode chosen.

On the other hand if the loom is operated in the mode using one source of weft thread supply, i.e. if only one type of weft thread is supplied from one supply package, and in particular if the thread processed is of high economic value the percentage of material and work wasted due to the elimination of the false selvedge is highly undesirable as such losses inherently represent a useless loss in so far as it is not necessary for leaving sufficient space for one or a plurality of weft thread changer devices. This is the case e.g. in the production of technical fabrics from glass fibres which can be realised on looms using one weft thread supply package only and which are made from a typical high cost material.

SUMMARY OF THE INVENTION

It thus is the objective of the present invention to completely eliminate the waste of material in the process of cutting the selvedge on the weft insertion side on a loom operated with one source of weft thread supply only and to ensure the formation of a narrow selvedge and a perfectly cut fabric edge.

The false selvedge is dispensed with as each weft thread inserted is cut while being held under tension in such a manner that no waste material is generated at all and that by cutting the thread using a scissors device of a type known a narrow selvedge is created of a length few millimeters, ideal for further processing in practice.

According to a preferred embodiment of the invention, a method for cutting a selvedge on a weft thread insertion side of a rapier loom equipped with a weft thread supply is provided. A free space of warp threads arranged separately from a main warp body is provided. The weft thread is inserted through an open shed of the warp body. The inserted weft thread is beaten and then placed into a holding device where it is subjected to tension. The weft thread is cut after being beaten and while subject to tension. The cut end of the weft thread is inserted it into the open shed of the warp after the cutting.

According to features of the invention, the weft thread is subject to tension by either mechanically blocking the weft thread or sucking the weft thread into a suction nozzle before it is cut.

In addition, the weft thread is preferably cut using scissors. When cut, the weft thread is preferably a distance no greater than 10 mm from the main warp body, and particularly between 4 mm and 5 mm.

BRIEF DESCRIPTION OF THE DRAWINGS

The present invention is described in more detail in the following with reference to the illustrations in the corresponding Figures. It is shown in the.

DETAILED DESCRIPTION OF THE EXEMPLARY EMBODIMENT

Figure 1:
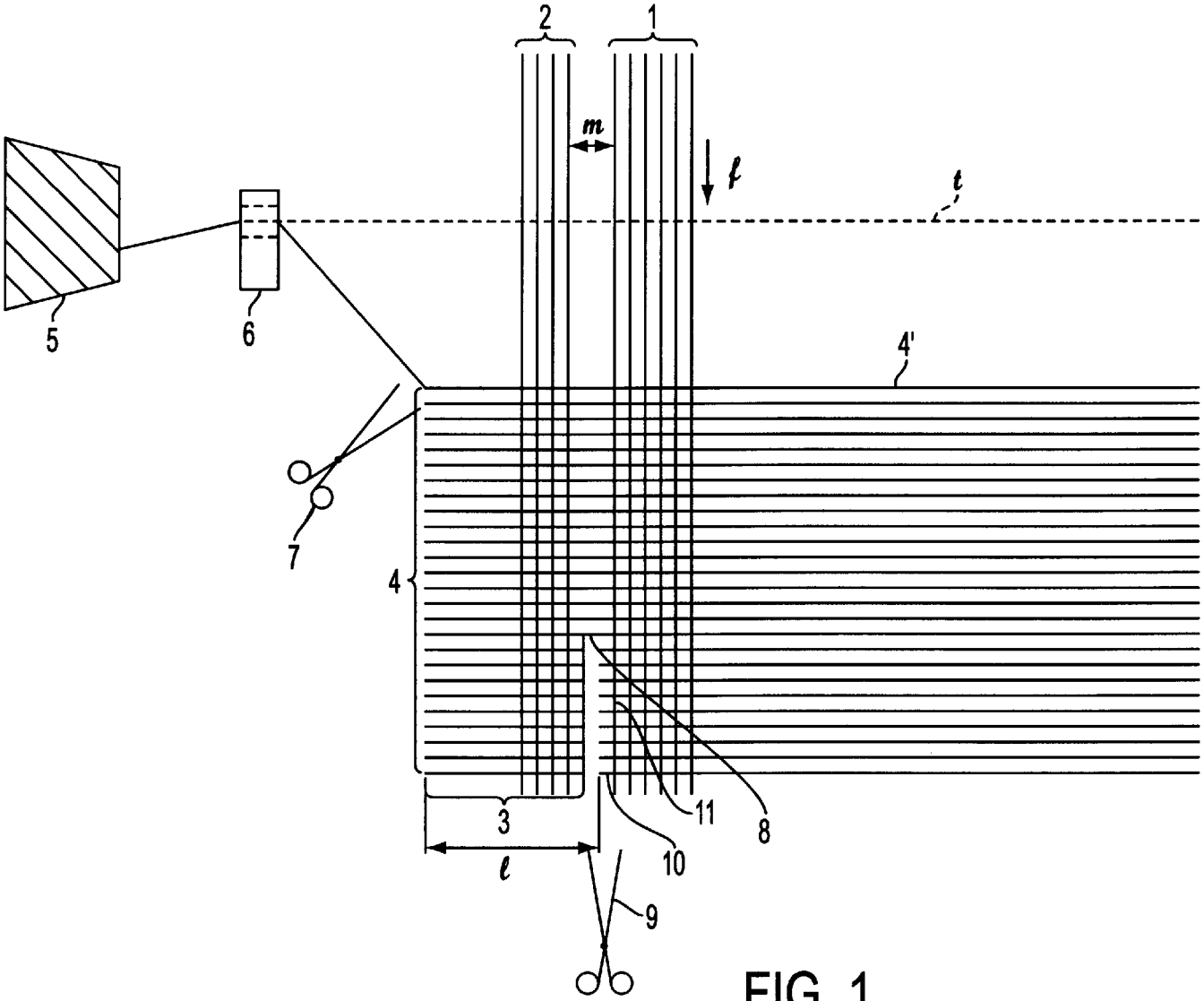
FIG. 1 A schematic view of the method according to the state of the art for cutting the selvedge on a rapier loom, FIG. 2 A schematic view of the inventive method for cutting the selvedge on a rapier loom.

In the FIG. 1 the known method of cutting the selvedge on a rapier loom is shown schematically the basic elements only being shown.

The warp threads are designated 1 which extend towards the right hand side in the Figure all the way to the end of the fabric produced. In the FIG. 1 only six of these threads are shown. The warp threads are supplied from a warp beam (not shown) and they move in the direction of the arrow f. As can be seen outside the row of threads of the main warp body 1 and at a distance of the width m therefrom a further series of a few warp threads 2 is provided which after weft insertion form a false selvedge 3. The weft threads inserted by means of known weaving elements (rapiers, shedforming elements of the loom, reed, etc.) which being conventional working elements are not shown in the Figure.

The weft thread 4' shown in the FIG. 1 is the last one just inserted and beaten up by the beat-up element (not shown) against the fabric being formed and the thread 4' on the weft insertion side of the fabric is still connected to the thread supply package 5 via a conventional thread supply element 6 a detailed description of which is dispensed with. The thread supply element 6 can be laid out for preparing a suitable length of weft thread in advance and thus for facilitating the take-off of the thread from the supply package 5.

Figure 3:
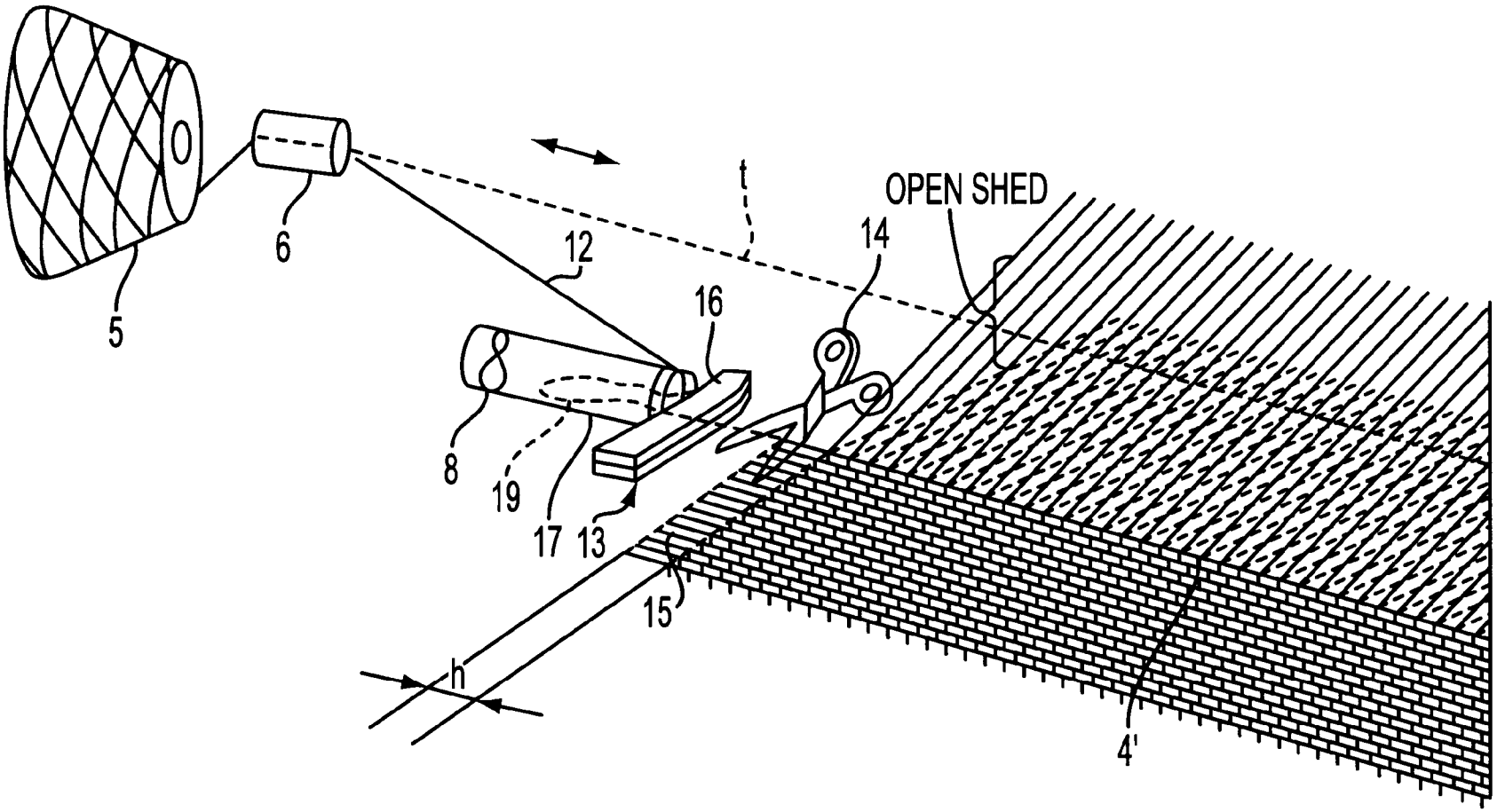
FIG. 3 is a perspective view of the device of FIG. 2.

The carrying clamp (not shown) serves for taking over the next weft thread from the thread supply device 6 at its free end and for pulling it through the opened shed (as seen in FIG. 3) following the trajectory indicated with dashed lines in the FIG. 1. For this purpose the weft thread 4' of course must be cut at its end on the weft insertion side. i.e. on the left hand side as shown in the FIG. 1. A cutting scissors device 7 then cuts the thread at a determined distance from the left hand side of the false selvedge.

Upon completion of the weaving action, i.e. after a certain number of weft threads has been inserted, the false selvedge 3 then is severed from the fabric at a cutting point 8 using a further scissors device 9 of conventional type which in the FIG. 1 is shown schematically merely. On the edge of the fabric edge a narrow final selvedge 10 is formed presenting short cut threads extending over a few millimeters the from the edge of the fabric 11 which all are of exactly the same length. The false selvedge 3 severed from the fabric is eliminated and represents pure waste which easily can attain several percentage points of the fabric produced as the length l easily can be 4 to 5 cm. Obviously the value of such waste makes itself felt all the more intensely the higher the price of the raw material used for producing the fabric is and the higher the quality requirements of the thread applied are.

A disadvantage of this working method, which is able to form a perfect selvedge of the fabric, is seen in that in order to form a perfect selvedge two scissors devices are required which always represent delicate elements requiring continual maintenance.

Figure 2:
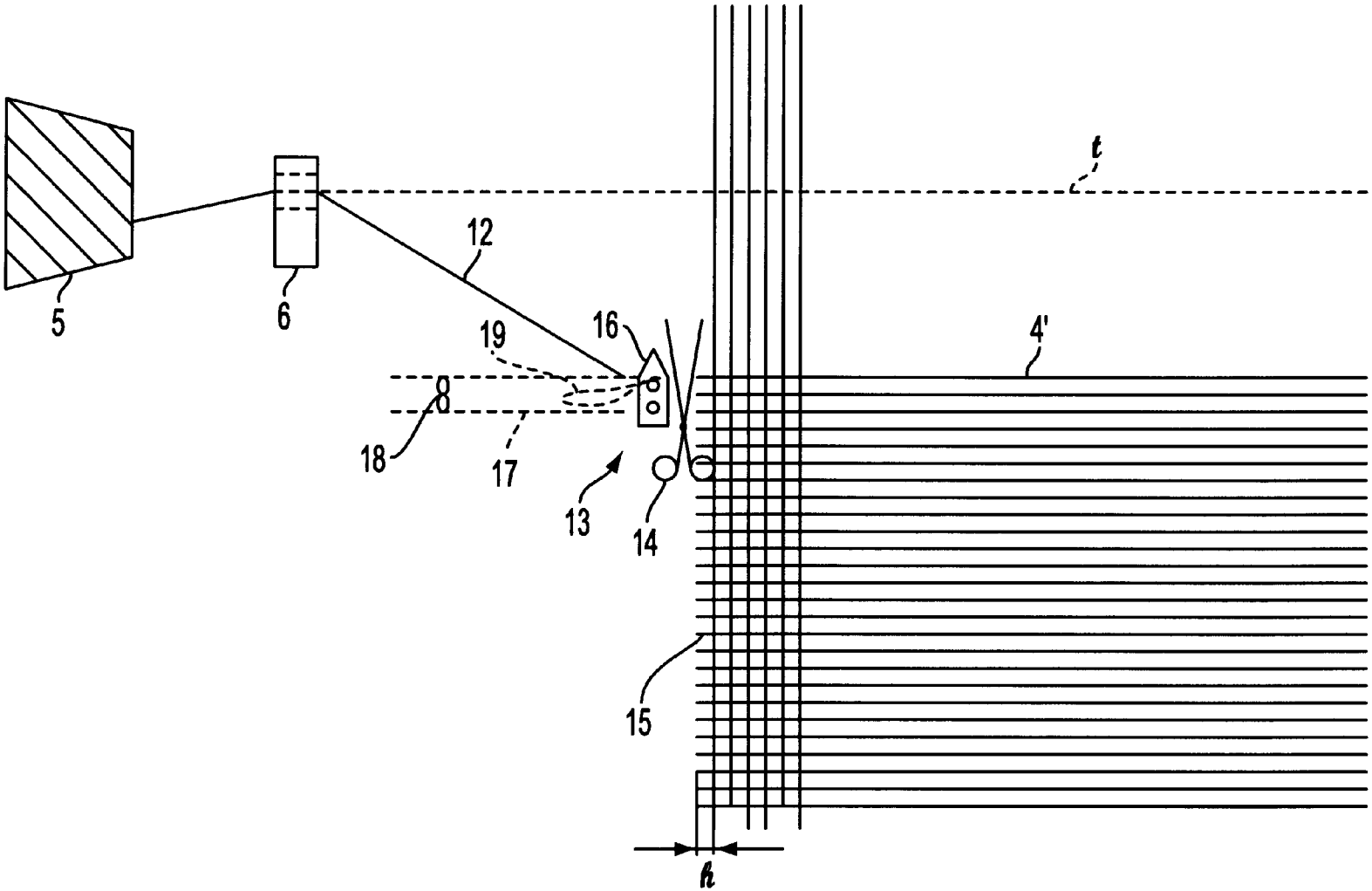

Against these disadvantages the inventive method now offers remedy in cutting the selvedge as shown in the FIG. 2. In this FIG. 2 the elements shown identically in the FIG. 1 already and performing the same functions are designated using the same reference signs.

In the inventive method the last-inserted weft thread 4' is beaten up by the beating-up element (not shown) of the loom against the fabric being formed into its final position and with its tail end 12, connecting it with the supply element 6 and the supply thread package 5, located in a holding device 13 which serves for holding the tail end 12 of the thread while a scissors device 14 cuts it between the fabric and the holding device 13. In this manner a narrow selvedge 15 is formed by short thread ends protruding from the fabric all cut to exactly the same length owing to the constant tension to which each thread is subject during the actual cutting phase.

It is to be noticed here that the length h of these free thread ends of the selvedge 15 normally is chosen smaller than 10 mm, and preferably ranges between 4 and 5 mm, which is effected by locating the scissors device 14, or its cutting line respectively, at a corresponding distance close to the nearest warp thread. As far as the scissors device is concerned, e.g. a conventional type of scissors device with alternating cutting movement can be used, a further description of which can be dispensed with here.

After the tail end of the thread 12 has been cut under tension by the scissors device 14 the thread which still extends from the supply element 6 now is taken over by the inserting clamp of the rapier (not shown) which carries the thread 12 which now forms the leading end of the weft thread through the opened shed of the loom along the line t of thread insertion. Obviously the length of the thread 12 from the holding device 13 to the thread supply device 6 which now forms the leading end of the new weft thread will be suitably chosen in such a manner that on one hand its take-over by the weft insertion clamp and its transfer to the pulling clamp at the centre of the fabric width is ensured and that on the other hand the formation of a selvedge of the length desired, preferably a narrow selvedge, is formed at the other side of the fabric. Thus the length of the thread 12 which can be determined in the design lay-out of the loom by suitably arranging the individual elements is not the only parameter for determining the length of the free selvedge on the right hand side of the fabric (as shown in the FIG. 2, i.e. on the side opposite to the weft insertion side of the fabric). Also other factors are influencing said length of the selvedge such as e.g. the braking action exerted by the brake acting on the weft thread towards the end of its passage through the shed cared by the clamps and other factors. The length of the thread 12 connecting the holding device 13 and the thread supply element 6 certainly plays its role in determining the length of the selvedge on the right hand side of the fabric but this is not the only element determining said length and thus there is no need to enter into the details of this aspect which moreover is not part of the problem to be solved by means of the present invention.

The thread holding device 13 can be laid out in various manners and can hold the thread tensioned using different principles. According to a first preferred embodiment of the present invention, shown with solid lines, but schematically merely, in the FIG. 2. the pull acting onto the thread is generated by the mechanical blockage of the thread held in a clamp 16 which consists e.g. of a fixed element and a movable element pressing against the fixed element with the help of a spring. The thread is clamped at the moment at which the beat-up device (or reed, not shown) has almost reached its beating point (i.e. during the last centimeters of its movement) between the clamping parts of the brake which hold the thread and block it. For this purpose the clamp presents a certain clamping width between its clamping elements which is perfectly aligned in the horizontal plane of the weft thread placed by the beat-up device. The clamp 16 of course can be operated also by other means than a spring mentioned above. The clamp could also be closed by a weight or by a magnet. This is not of particular importance within the scope of the present invention according to which just a mechanical clamp is required which is able to clamp and hold the thread during the cutting phase which thus is effected the thread being tensioned between the edge of the fabric and the holding device.

According to a further preferred alternative embodiment of the present invention, indicated schematically only with dashed lines in the FIG. 2, the pulling action exerted on he thread being performed applying suction to the weft thread using a suction nozzle 17 located in the vicinity of the point where the weft thread is placed by the beat-up (in practice at the same point at which according to the alterative method described above the clamp 16 was arranged). The suction action exerted by the suction nozzle 17, connected to a source of vacuum or below atmospheric pressure 18, sucks in a short loop of thread 19 into the nozzle 17 thus holding the weft thread which is subject to a pulling force while the thread is cut by the scissors device 14. Also in this case the length of the thread 12 connecting the holding device and the thread supply element 6 is of importance, but not being the only factor, in determining the length of the thread of the selvedge formed on the right hand side of the fabric (as shown in the FIG. 2) where also the additional length of the thread loop 19 sucked into the suction nozzle 17 is to be taken into account. The type of holding device 13, e.g. mechanical or pneumatic, chosen for application within the scope of the present invention depends on a number of factors the importance of which can be judged differently in every case of application. Thus a mechanical clamping mechanism permits the formation of shorter lengths of the connecting thread 12 than the one which can be formed using a suction nozzle which in turn presents the advantage of effecting an automatic cleaning operation in a susceptible zone of the loom. The choice of the type of the holding device 13 thus depends on a number of factors to be evaluated in each case. The only requirement within the scope of the present invention stipulates that the holding device be located in immediate vicinity of the scissors device 14 and that it must exert a tensile force onto the thread before and during the cutting action performed by the scissors device 14.

The inventive method preferably is implemented according to a determined sequence of operating steps which are the following:

a) Insertion of the weft thread through the open shed (not shown) along the trajectory line t, b) The weft thread inserted is beaten up by the beat-up device or reed (not shown) and the end of the weft thread on the thread insertion side is placed into the holding device 13 which holds it tensioned during the subsequent cutting action, c) The weft thread is cut using a cutting device 14 after the beat-up device has beaten up the weft thread, d) The tail end of the weft thread is taken over from the holding device 13 by the carrying clamp (not shown) and is inserted into the open shed of the warp.

The operating cycle is repeated in this manner and after every beat-up of a weft thread a short selvedge thread 15 is cut without any material being wasted. Owing to this manner of operation raw material thus is saved with great economic advantage and furthermore the design of the machine is simplified as the inventive method compared to the conventional method described in the introduction requires one scissors device 14 only instead of the two required conventionally.

Practical experience has shown that the inventive method can be applied on rapier looms processing glass for producing technical fabrics mainly. Such fabrics as a rule are characterized in that highest quality threads are used without broken fibrils which thus are expensive. Evidently the savings obtainable in producing such fabrics by eliminating the conventional false selvedge are higher than if lower price threads are processed. Furthermore such fabrics normally are solid color fabrics and thus the limitations in the application of the inventive method due to the difficulties of adapting it to looms equipped with a plurality of weft thread sources—as thread changer devices have to be provided—are non existent in this case. On looms with a plurality of weft thread sources also multiple thread supply elements and the holding devices would have to be provided which would result in a considerable complication of the lay-out for implementing the inventive method described which thus preferably is implemented on looms with one weft thread supply.

What is claimed is:

1. A method for cutting a selvedge on a weft thread insertion side of a rapier loom equipped with a weft thread supply, said method comprising:

providing a free space of warp threads arranged separately from a main warp body;

inserting a weft thread through an open shed of said warp body;

beating said inserting weft thread;

placing an insertion side weft end into a holding device after said beating;

subjecting the inserted weft thread to tension;

cutting said weft thread after it has been beaten up, and during said subjecting; and inserting a cut end of said weft thread into said open shed of said warp body after said cutting.

2. The method of claim 1, wherein said subjecting includes mechanically blocking said weft thread, and said cutting employs a scissors.

3. The method of claim 1, wherein said subjecting includes sucking said weft thread into a suction nozzle before said cutting, and said cutting employs a scissor.

4. The method of claim 1, wherein during said cutting, said weft thread is a distance no greater than 10 mm from said main warp body.

5. The method of claim 4, wherein said distance is between 4 mm and 5 mm.

6. A method for cutting a selvedge on a weft thread insertion side of a rapier loom equipped with a single weft thread supply only, said method comprising:

inserting said weft thread through an open shed of a warp;

beating said weft thread;

placing an end of said weft thread of a weft insertion side of the fabric into a holding device;

cutting said weft thread using scissors, said cutting following said beating;

taking a cut end of said weft thread from said holding device; and inserting said cut end into the open shed of the warp.

7. The method of claim 6, further comprising tensioning said weft thread during said beating.

8. The method of claim 7, wherein said tensioning includes mechanically blocking said thread.

9. The method of claim 8, wherein said tensioning includes sucking said weft thread into a suction nozzle.

* * * * *